US012134010B2

(12) United States Patent
Watanabe

(10) Patent No.: US 12,134,010 B2
(45) Date of Patent: Nov. 5, 2024

(54) MULTI-PIECE SOLID GOLF BALL

(71) Applicant: BRIDGESTONE SPORTS CO., LTD., Tokyo (JP)

(72) Inventor: Hideo Watanabe, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 18/193,842

(22) Filed: Mar. 31, 2023

(65) Prior Publication Data

US 2023/0310947 A1 Oct. 5, 2023

(30) Foreign Application Priority Data

Apr. 4, 2022 (JP) ..... 2022-062202

(51) Int. Cl.
*A63B 37/06* (2006.01)
*A63B 37/00* (2006.01)

(52) U.S. Cl.
CPC ..... *A63B 37/0039* (2013.01); *A63B 37/0033* (2013.01); *A63B 37/0034* (2013.01); *A63B 37/0043* (2013.01); *A63B 37/0045* (2013.01); *A63B 37/0046* (2013.01)

(58) Field of Classification Search
CPC ..... A63B 37/0072; A63B 37/0076; A63B 37/0081; A63B 37/0087; A63B 37/0092
See application file for complete search history.

(56) References Cited

U.S. PATENT DOCUMENTS 5,980,396 A 11/1999 Moriyama et al.
6,251,031 B1 6/2001 Hayashi et al.
6,361,454 B1 3/2002 Yoshida et al.
6,743,122 B2 6/2004 Hayashi et al.
2001/0019971 A1 9/2001 Hayashi et al.
2005/0170909 A1 8/2005 Hayashi
2008/0146377 A1* 6/2008 Watanabe ..... A63B 37/0033 473/376

(Continued)

FOREIGN PATENT DOCUMENTS

JP 10-295852 A 11/1998
JP 2000-61000 A 2/2000

(Continued)

*Primary Examiner* — Raeann Gorden
(74) *Attorney, Agent, or Firm* — Sughrue Mion, PLLC

(57) ABSTRACT

In a multi-piece solid golf ball having a core, an envelope layer, an intermediate layer and a cover, the core is formed of one or more layer of a rubber composition; the envelope layer, intermediate layer and cover are each formed of a single layer of resin material; the hardness relationship among the layers satisfies the following two conditions:

material hardness of cover>material hardness of intermediate layer, and material hardness of envelope layer≥surface hardness of core;

the ball additionally satisfies the condition:

envelope layer thickness (mm)×envelope layer material hardness (Shore D hardness) cover thickness (mm)× cover material hardness (Shore D hardness); and the core and ball have optimized deflections when subjected to a specific loading. This ball serves as a distance ball which enables a superior distance to be achieved on full shots with a driver and with irons.

8 Claims, 2 Drawing Sheets

(56) References Cited

U.S. PATENT DOCUMENTS

| | | | | |
|---|---|---|---|---|
| 2009/0111610 | A1* | 4/2009 | Watanabe | A63B 37/0039 473/376 |
| 2010/0273575 | A1 | 10/2010 | Watanabe | |
| 2013/0316850 | A1 | 11/2013 | Inoue et al. | |
| 2014/0194221 | A1 | 7/2014 | Watanabe et al. | |
| 2016/0008667 | A1 | 1/2016 | Watanabe et al. | |
| 2016/0279484 | A1 | 9/2016 | Watanabe et al. | |
| 2019/0351292 | A1 | 11/2019 | Watanabe et al. | |
| 2020/0197756 | A1* | 6/2020 | Watanabe | A63B 37/00621 |
| 2020/0353317 | A1* | 11/2020 | Watanabe | A63B 37/0044 |
| 2021/0170237 | A1 | 6/2021 | Watanabe | |

FOREIGN PATENT DOCUMENTS

| | | | |
|---|---|---|---|
| JP | 2000-61002 | A | 2/2000 |
| JP | 2000-140160 | A | 5/2000 |
| JP | 2001-218872 | A | 8/2001 |
| JP | 2005-218859 | A | 8/2005 |
| JP | 2010-253268 | A | 11/2010 |
| JP | 2013-244129 | A | 12/2013 |
| JP | 2014-132955 | A | 7/2014 |
| JP | 2016-16117 | A | 2/2016 |
| JP | 2016-179052 | A | 10/2016 |
| JP | 2019-198467 | A | 11/2019 |
| JP | 2021-87743 | A | 6/2021 |

* cited by examiner

MULTI-PIECE SOLID GOLF BALL

CROSS-REFERENCE TO RELATED APPLICATION

This non-provisional application claims priority under 35 U.S.C. § 119(a) on Patent Application No. 2022-062202 filed in Japan on Apr. 4, 2022, the entire contents of which are hereby incorporated by reference.

TECHNICAL FIELD

The present invention relates to a multi-piece solid golf ball of four or more layers that has a core, an envelope layer, an intermediate layer and a cover.

BACKGROUND ART

Many innovations have been made in designing golf balls with multilayer constructions, and numerous balls that satisfy the needs of not only professional golfers, but also ordinary amateur golfers ranging from beginners to advanced amateurs, have been developed to date. For example, functional multi-piece solid golf balls in which the material hardnesses and surface hardnesses of the respective layers the core, envelope layer, intermediate layer and cover (outermost layer) have been optimized are in wide use. Also, a number of technical disclosures have been published which focus on the hardness profile of the core that accounts for most of the ball volume and, by creating various core interior hardness designs, provide high-performance golf balls.

Examples of such literature include JP-A 2000-061002, JP-A 2000-061000, JP-A 2001-218872, JP-A 2005-218859, JP-A 2010-253268, JP-A 2014-132955, JP-A 2016-016117, JP-A 2016-179052, JP-A 2019-198467, JP-A 2021-087743, JP-A H10-295852, JP-A 2000-140160 and JP-A 2013-244129. These disclosures, all of which describe golf balls having a multilayer construction of four or more layers, relate to so-called distance balls in which the cover serving as the outermost layer has been designed so as to be harder than the intermediate layer.

However, there remains room for improvement in optimizing the core hardness profile and the relationship among the thicknesses of the various layers in these prior-art golf balls. That is, particularly when these golf balls are played by amateur golfers whose head speeds are not high, it has been difficult to achieve a fully satisfactory distance. Such golf balls, although capable of achieving a satisfactory flight on shots with a driver, have been unable to provide a superior distance performance on full shots with an iron. Accordingly, from the standpoint of achieving a superior distance on full shots with a driver (W #1) and with irons, there remains room for improvement in such distance-type golf balls.

SUMMARY OF THE INVENTION

It is therefore an object of the present invention to provide, in a distance-type golf ball, a golf ball which can achieve a superior distance on full shots with a driver and with irons.

As a result of intensive investigations, I have discovered that, in a multi-piece solid golf ball having a core, an envelope layer, an intermediate layer and a cover, certain desirable effects can be achieved by forming the core of a rubber composition, forming the envelope layer, intermediate layer and cover each of a resin material, and constructing the golf ball such that the Shore C hardness relationships among the layers satisfy the following two conditions:

material hardness of cover>material hardness of intermediate layer, and material hardness of envelope layer≥surface hardness of core, such that the ball additionally satisfies the following condition:

thickness (mm) of envelope layer×material hardness (Shore D hardness) of envelope layer≥thickness (mm) of cover×material hardness (Shore D hardness) of cover, and moreover such that, letting C be the deflection of the core in millimeters when compressed under a final load of 1,275 N (130 kgf) from an initial load of 98 N (10 kgf) and B be the deflection of the ball in millimeters when compressed under a final load of 1,275 N (130 kgf) from an initial load of 98 N (10 kgf), C−B has a value of 1.00 mm or more. Namely, such a ball is able to achieve an excellent distance not only on full shots with a driver but also on full shots with an iron.

That is, the golf ball of the invention has a structure in which each of the three layers that encase the core (i.e., the envelope layer, the intermediate layer and the cover) is formed of a resin material, and the cover is formed so as to be harder than the intermediate layer. This golf ball has a superior distance performance on full shots with a driver and also has a superior distance performance on full shots with irons, and thus satisfies the performance requirements of the ordinary amateur golfer. Moreover, the golf ball of the invention satisfies the desire for a good, soft feel at impact and also possesses an excellent durability to cracking on repeated impact.

Accordingly, the invention provides a multi-piece solid golf ball having a core, an envelope layer, an intermediate layer and a cover, wherein the core is formed of one or more layer of a rubber composition; the envelope layer, intermediate layer and cover are each formed of a single layer of resin material; the hardness relationship among the layers, in terms of Shore C hardness values, satisfies the following two conditions:

material hardness of cover>material hardness of intermediate layer, and material hardness of envelope layer≥surface hardness of core;

the ball additionally satisfies the condition:

thickness (mm) of envelope layer×material hardness (Shore D hardness) of envelope layer≥thickness (mm) of cover×material hardness (Shore D hardness) of cover; and, letting C be the deflection of the core in millimeters when compressed under a final load of 1,275 N (130 kgf) from an initial load of 98 N (10 kgf) and B be the deflection of the ball in millimeters when compressed under a final load of 1,275 N (130 kgf) from an initial load of 98 N (10 kgf), C−B has a value of 1.00 mm or more.

In a preferred embodiment of the golf ball of the invention, the ball additionally satisfies the following condition:

thickness (mm) of envelope layer×material hardness (Shore *D* hardness) of envelope layer≥thickness (mm) of intermediate layer×material hardness (Shore *D* hardness) of intermediate layer.

In another preferred embodiment of the inventive golf ball, the ball satisfies the condition:

(cover thickness+intermediate layer thickness)<envelope layer thickness.

In yet another preferred embodiment, the hardness relationship among the layers, in terms of Shore C hardness values, satisfies the following condition:

material hardness of cover>material hardness of intermediate layer>material hardness of envelope layer≥surface hardness of core.

In still another preferred embodiment, the resin material making up either or both of the envelope layer and the intermediate layer is a highly neutralized resin material which includes:

100 parts by weight of a resin component consisting of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio (a-1):(a-2) of between 100:0 and 0:100, and (B) a non-ionomeric thermoplastic elastomer in a weight ratio (A):(B) of between 100:0 and 50:50;

and also includes, blended therewith as essential ingredients:

(C) from 5 to 120 parts by weight of a fatty acid and/or a fatty acid derivative having a molecular weight of from 228 to 1,500, and (D) from 0.1 to 17 parts by weight of a basic inorganic metal compound capable of neutralizing un-neutralized acid groups in components (A) and (C).

In the foregoing preferred embodiment, the resin materials of both the envelope layer and the intermediate layer may be highly neutralized resin materials of mutually differing types which include components (A) to (D) as essential ingredients.

In a further preferred embodiment, the layers of the ball have a thickness relationship that satisfies the following condition:

envelope layer thickness/(cover thickness+intermediate layer thickness)≥1.2.

In a yet further preferred embodiment, the core and the ball have diameters that satisfy the following relationship:

0.65≤(cover diameter)/(ball diameter)≤0.78.

In a still further preferred embodiment, the golf ball satisfies the condition:

$$0.80 \leq (E \cdot vh + I \cdot vh)/\text{Core} \cdot vh \leq 2.00,$$

wherein Core·vh is the value expressed as [core volume ($mm^3$)×(Shore C hardness at core surface+Shore C hardness at core center)/2], E·vh is the value expressed as [volume ($mm^3$) of envelope layer material portion×Shore C hardness of envelope layer material] and I·vh is the value expressed as [volume ($mm^3$) of intermediate layer material portion× Shore C hardness of intermediate layer material].

Advantageous Effects of the Invention

The golf ball of the invention has a superior distance performance on full shots with a driver (W #1) and with irons, provides a good, soft feel at impact, and has an excellent durability to cracking on repeated impact.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
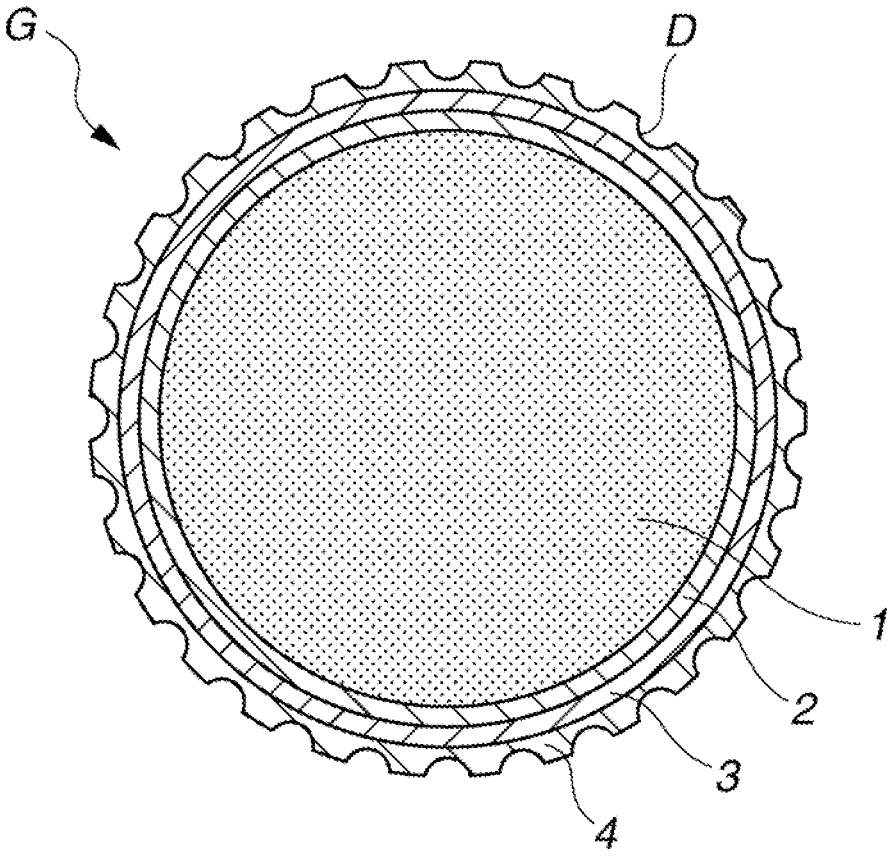
FIG. 1 is a schematic cross-sectional view of the multi-piece solid golf ball of the invention having a four-layer construction.

The multi-piece solid golf ball of the invention is, as shown in FIG. 1, a golf ball G of four or more layers which has a core 1, an envelope layer 2 encasing the core 1, an intermediate layer 3 encasing the envelope layer 2, and a cover 4 encasing the intermediate layer 3. Numerous dimples D are typically formed on the surface of the cover 4. Although not shown in the diagram, a coating layer is normally applied onto the surface of the cover 4. Aside from the coating layer, the cover 4 is positioned as the outermost layer in the layered construction of the ball. The core 1 is not limited to a single layer, and may be formed as two or more layers. However, the envelope layer 2, the intermediate layer 3 and the cover 4 are each formed as single layers.

The core is obtained by vulcanizing a rubber composition composed primarily of a rubber material. This rubber composition is typically obtained by using a base rubber as the chief component and including with this such ingredients as a co-crosslinking agent, a crosslinking initiator, an inert filler and an organosulfur compound.

It is preferable to use polybutadiene as the base rubber. Commercial products may be used as the polybutadiene. Illustrative examples include BR01, BR51 and BR730 (all from JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

The co-crosslinking agent is an α,β-unsaturated carboxylic acid and/or a metal salt thereof. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids include, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 5 parts by weight, preferably at least 9 parts by weight, and more preferably at least 13 parts by weight. The amount included is typically not more than 60 parts by weight, preferably not more than 50 parts by weight, and more preferably not more than 40 parts by weight. Too much may make the core too hard, giving the ball an unpleasant feel at impact, whereas too little may lower the rebound.

It is preferable to use an organic peroxide as the cross-linking initiator. Commercial organic peroxides may be used for this purpose. Examples of such products that may be suitably used include Percumyl D, Perhexa C-40 and Perhexa 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, and even more preferably at least 0.5 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a suitable feel, durability and rebound.

Examples of substances that may be suitably used as the filler include zinc oxide, barium sulfate and calcium carbonate. One of these may be used alone, or two or more may be used together. The amount of filler included per 100 parts by weight of the base rubber is preferably at least 1 part by weight, and more preferably at least 3 parts by weight. The upper limit is preferably not more than 200 parts by weight, more preferably not more than 150 parts by weight, and even more preferably not more than 100 parts by weight. Too much or too little filler may make it impossible to obtain a proper ball weight and a suitable rebound.

Commercial products such as Nocrac NS-6, Nocrac NS-30, Nocrac 200 and Nocrac MB (all available from Ouchi Shinko Chemical Industry Co., Ltd.) may be used as the antioxidant. One of these may be used alone, or two or more may be used together.

The amount of antioxidant included per 100 parts by weight of the base rubber, although not particularly limited, is preferably at least 0.05 part by weight, and more preferably at least 0.1 part by weight. The upper limit is preferably not more than 1.0 part by weight, more preferably not more than 0.7 part by weight, and even more preferably not more than 0.5 part by weight. Too much or too little antioxidant may make it impossible to achieve the proper core hardness gradient, as a result of which it may not be possible to obtain a suitable rebound, durability and spin rate-lowering effect on full shots.

An organosulfur compound may be included in the rubber composition in order to impart a good resilience. The inclusion of a thiophenol, thionaphthol, halogenated thionaphthol or metal salt thereof is recommended. Specific examples include pentachlorothiophenol, pentafluorothiophenol, pentabromothiophenol, p-chlorothiophenol, the zinc salt of pentachlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol and diphenyldisulfides is especially preferred.

The organosulfur compound is included in an amount, per 100 parts by weight of the base rubber, of not more than 5 parts by weight, preferably not more than 4 parts by weight, more preferably not more than 3 parts by weight, and most preferably not more than 2 parts by weight. Including too much organosulfur compound may make the core too soft; including too little may make a rebound-improving effect unlikely.

The core can be produced by vulcanizing and curing the rubber composition containing the above ingredients. For example, the core can be produced by using a Banbury mixer, roll mill or other mixing apparatus to intensively mix the ingredients, subsequently compression molding or injection molding the mixture in a core mold, and curing the resulting molded body by suitably heating it under conditions sufficient to allow the organic peroxide and co-cross-linking agent to act, such as at a temperature of between 100 and 200° C., preferably between 140 and 180° C., for 10 to 40 minutes.

In this invention, the core is formed as a single layer or as a plurality of layers. When a multilayer rubber core is produced, in cases where the hardness difference at the interface between these rubber layers is large, separation at the interface may occur with repeated impact and a loss in the initial velocity of the ball on full shots may arise.

The core diameter is preferably at least 27.5 mm, more preferably at least 28.5 mm, and even more preferably at least 29.5 mm. The upper limit in the core diameter is preferably not more than 33.5 mm, more preferably not more than 32.5 mm, and even more preferably not more than 32.0 mm. Outside of this range, it is difficult to obtain both a low spin rate on full shots and a high initial velocity, as a result of which it may be difficult to achieve the desired distance.

The core has a deflection (mm) when compressed under a final load of 1,275 N (130 kgf) from an initial load of 98 N (10 kgf) which, although not particularly limited, is preferably at least 3.3 mm, more preferably at least 3.5 mm, and even more preferably at least 3.7 mm. The upper limit is preferably not more than 6.0 mm, more preferably not more than 5.0 mm, and even more preferably not more than 4.5 mm. When the core deflection is too small, i.e., when the core is too hard, the spin rate of the ball may rise excessively, resulting in a poor distance, or the feel at impact may be too hard. On the other hand, when the core deflection is too large, i.e., when the core is too soft, the ball rebound may become too low, resulting in a poor distance, the feel at impact may be too soft, or the durability to cracking on repeated impact may worsen.

Next, the core hardness profile is described. The core hardnesses mentioned below are Shore C hardnesses. These Shore C hardnesses are hardness values measured with a Shore C durometer in accordance with ASTM D2240.

The core has a center hardness (Cc) which is preferably at least 50, more preferably at least 55, and even more preferably at least 60. The upper limit value is preferably not more than 66, more preferably not more than 65, and even more preferably not more than 64. When this value is too large, the feel at impact may harden or the spin rate on full shots may rise, as a result of which the intended distance may not be achieved. On the other hand, when this value is too small, the rebound may decrease, resulting in a poor distance, or the durability to cracking on repeated impact may worsen.

The core has a surface hardness (Cs) which is preferably at least 68, more preferably at least 70, and even more preferably at least 72. The upper limit is preferably not more than 83, more preferably not more than 80, and even more preferably not more than 78. A surface hardness outside of this range may lead to undesirable results similar to those described above in connection with the core center hardness (Cc).

The difference between the core surface hardness (Cs) and the core center hardness (Cc) is preferably at least 8, more preferably at least 10, and even more preferably at least 12. The upper limit value is preferably not more than 25, more preferably not more than 20, and even more preferably not more than 16. When this value is too small, the spin rate-lowering effect on full shots may be inadequate and a good distance may not be achieved. On the other hand, when this difference is too large, the initial velocity on shots may decrease, resulting in a poor distance, or the durability of the ball to cracking on repeated impact may worsen.

Next, the envelope layer is described.

The envelope layer has a material hardness on the Shore D hardness scale which, although not particularly limited, is preferably at least 36, more preferably at least 41, and even more preferably at least 46. The upper limit is preferably not more than 58, more preferably not more than 56, and even more preferably not more than 54.

The envelope layer material hardness on the Shore C hardness scale is preferably at least 58, more preferably at least 64, and even more preferably at least 71. The upper limit is preferably not more than 87, more preferably not more than 84, and even more preferably not more than 82. When the material hardnesses of the envelope layer are too much lower than the above ranges, the spin rate of the ball on full shots may rise or the initial velocity may decrease, as a result of which the intended distance may not be achieved. On the other hand, when the material hardnesses are too high, the spin rate of the ball on full shots may rise, as a result of which the intended distance may not be achieved, or the feel at impact may become too hard.

The envelope layer has a thickness which is preferably at least 2.1 mm, more preferably at least 2.5 mm, and even more preferably at least 2.8 mm. The upper limit in the envelope layer thickness is preferably not more than 4.8 mm, more preferably not more than 4.4 mm, and even more preferably not more than 4.2 mm. When the envelope layer is too thick or too thin, it is difficult to obtain both a lower spin rate on full shots and a high initial velocity, as a result of which the desired distance may not be achieved.

In this invention, it is preferable for the thickness relationship among the layers to satisfy the following condition:

(cover thickness+intermediate layer thickness)<envelope layer thickness.

The envelope layer is made of a resin material. Various types of thermoplastic resin materials in particular may be suitably used. Preferred use can be made of, for example, a resin composition which includes:

100 parts by weight of a resin component consisting of, in admixture, (A) a base resin of (a-1) an olefin-unsaturated carboxylic acid random copolymer and/or a metal ion neutralization product of an olefin-unsaturated carboxylic acid random copolymer blended with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio (a-1):(a-2) of between 100:0 and 0:100, and (B) a non-ionomeric thermoplastic elastomer in a weight ratio (A):(B) of between 100:0 and 50:50;

and which also includes, blended therewith as essential ingredients:

(C) from 5 to 120 parts by weight of a fatty acid and/or a fatty acid derivative having a molecular weight of from 228 to 1,500, and (D) from 0.1 to 17 parts by weight of a basic inorganic metal compound capable of neutralizing un-neutralized acid groups in components (A) and (C).

Components (A) to (D) in the intermediate layer-forming resin material described in, for example, JP-A 2010-253268 may be advantageously used as above components (A) to (D).

Exemplary non-ionomeric thermoplastic elastomers include polyolefin elastomers (including polyolefins and metallocene polyolefins), polystyrene elastomers, diene polymers, polyacrylate polymers, polyamide elastomers, polyurethane elastomers, polyester elastomers and polyacetals. A thermoplastic polyether ester elastomer is especially preferred.

Depending on the intended use, optional additives may be suitably included in the above resin material. For example, various types of additives such as pigments, dispersants, antioxidants, ultraviolet absorbers and light stabilizers may be added.

Next, the intermediate layer is described.

The intermediate layer has a material hardness on the Shore D hardness scale which, although not particularly limited, is preferably at least 40, more preferably at least 45, and even more preferably at least 50. The upper limit is preferably not more than 62, more preferably not more than 60, and even more preferably not more than 58. The material hardness on the Shore C hardness scale is preferably at least 63, more preferably at least 70, and even more preferably at least 76. The upper limit is preferably not more than 92, more preferably not more than 89, and even more preferably not more than 87. When the material hardnesses of the intermediate layer are lower than the above ranges, the spin rate of the ball on full shots may rise excessively and a good distance may not be attained, or the durability to cracking on repeated impact may worsen. On the other hand, when the material hardnesses of the intermediate layer are higher than the above ranges, the durability to cracking on repeated impact may worsen or the feel at impact may worsen.

The intermediate layer has a thickness which is preferably at least 0.7 mm, more preferably at least 0.9 mm, and even more preferably at least 1.1 mm. The upper limit in the intermediate layer thickness is preferably not more than 1.5 mm, more preferably not more than 1.4 mm, and even more preferably not more than 1.3 mm. When the intermediate layer thickness is too small, the durability to cracking on repeated impact may worsen, or the feel at impact may worsen. On the other hand, when the intermediate layer thickness is too large, the spin rate on full shots may rise and a good distance may not be achieved.

The intermediate layer material may be suitably selected from among various types of thermoplastic resins that are used as golf ball materials. From the standpoint of attaining a superior distance due to a lowering of the spin rate on full shots, an ionomer resin is preferred, with the use of the highly neutralized resin material containing components (A) to (D) described above in connection with the envelope layer material being more preferred. In cases where highly neutralized resin materials are used in both the envelope layer and the intermediate layer, they are mutually differing types of highly neutralized resin materials.

Depending on the intended use of the ball, optional additives may be suitably included in the intermediate layer material. For example, various types of additives such as pigments, dispersants, antioxidants, ultraviolet absorbers and light stabilizers may be added. When these additives are included, the amount thereof per 100 parts by weight of the base resin is preferably at least 0.1 part by weight, and more preferably at least 0.5 part by weight; the upper limit is preferably not more than 10 parts by weight, and more preferably not more than 4 parts by weight.

Next, the cover serving as the outermost layer is described.

The cover has a material hardness on the Shore D scale which, although not particularly limited, is preferably at least 55, more preferably at least 59, and even more preferably at least 61. The upper limit is preferably not more than 70, more preferably not more than 68, and even more preferably not more than 65. The material hardness on the Shore C scale is preferably at least 83, more preferably at least 88, and even more preferably at least 91. The upper limit is preferably not more than 100, more preferably not more than 98, and even more preferably not more than 96. When the material hardnesses of the cover are lower than the above ranges, the spin rate of the ball on shots with a driver may rise and the initial velocity of the ball may decrease, as a result of which a good distance may not be achieved. On the other hand, when the material hardnesses of the cover are too high, the durability to cracking on repeated impact may worsen.

The cover has a thickness which is preferably at least 0.6 mm, more preferably at least 0.8 mm, and even more preferably at least 1.1 mm. The upper limit in the cover thickness is preferably not more than 1.7 mm, more preferably not more than 1.5 mm, and even more preferably not more than 1.3 mm. When the cover is too thin, the durability to cracking on repeated impact may worsen. On the other hand, when the cover is too thick, the spin rate on shots with a driver (W #1) may rise excessively, resulting in a poor distance, or the feel of the ball in the short game and on shots with a putter may become too hard.

Various types of thermoplastic resins used as golf ball materials may be suitably used as the cover material. In particular, from the standpoint of lowering the spin rate on full shots and thereby attaining a superior distance, the use of an ionomer resin is preferred.

Depending on the intended use of the ball, optional additives may be suitably included in the cover material. For example, various types of additives such as pigments, dispersants, antioxidants, ultraviolet absorbers and light stabilizers may be included. When these additives are included, the amount thereof per 100 parts by weight of the base resin is preferably at least 0.1 part by weight, and more preferably at least 0.5 part by weight; the upper limit is preferably not more than 10 parts by weight, and more preferably not more than 4 parts by weight.

The manufacture of multi-piece solid golf balls in which the above-described core, envelope layer, intermediate layer and cover (outermost layer) are formed as successive layers may be carried out in the usual manner, such as by a known injection molding process. For example, a golf ball can be produced by successively injection-molding the envelope layer and the intermediate layer material over the core in respective injection molds so as to obtain first the envelope layer-encased sphere and then the intermediate layer-encased sphere, and subsequently injection-molding the material for the cover serving as the outermost layer over the intermediate layer-encased sphere. Alternatively, the encasing layers may each be formed by enclosing the sphere to be encased within two pre-molded hemispherical half-cups and then molding under applied heat and pressure.

The golf ball has a deflection (mm) when compressed under a final load of 1,275 N (130 kgf) from an initial load of 98 N (10 kgf) which is preferably at least 2.5 mm, more preferably at least 2.6 mm, and even more preferably at least 2.7 mm. The upper limit is preferably not more than 3.5 mm, more preferably not more than 3.3 mm, and even more preferably not more than 3.1 mm. When the ball deflection is too small, i.e., when the ball is too hard, the spin rate of the ball may rise excessively, resulting in a poor distance, or the feel at impact may be too hard. On the other hand, when the ball deflection is too large, i.e., when the ball is too soft, the ball rebound may become too low, resulting in a poor distance, the feel at impact may be too soft, or the durability to cracking on repeated impact may worsen.

Letting C be the deflection of the core in millimeters when compressed under a final load of 1,275 N (130 kgf) from an initial load of 98 N (10 kgf) and B be the deflection of the ball in millimeters when compressed under a final load of 1,275 N (130 kgf) from an initial load of 98 N (10 kgf), the value C−B is preferably at least 1.00 mm, more preferably at least 1.05 mm, and even more preferably at least 1.10 mm. The upper limit value is preferably not more than 1.60 mm, more preferably not more than 1.50 mm, and even more preferably not more than 1.40 mm. When this value is too small, the spin rate on full shots may rise, as a result of which the intended distance may not be attainable. On the other hand, when this value is too large, the initial velocity on full shots may decrease, as a result of which the intended distance may not be attainable.

Hardness Relationships Among Layers

In this invention, the hardness relationship among the layers, in terms of Shore C hardness values, must satisfy the following conditions:

material hardness of cover>material hardness of intermediate layer, and material hardness of envelope layer≥surface hardness of core;

and preferably satisfies the following condition:

material hardness of cover>material hardness of intermediate layer>material hardness of envelope layer≥surface hardness of core.

The value obtained by subtracting the material hardness of the intermediate layer from the material hardness of the cover, expressed on the Shore C hardness scale, is larger than 0, preferably 3 or more, and more preferably 7 or more. The upper limit value is preferably not more than 25, more preferably not more than 18, and even more preferably not more than 12. When this value is too small, the spin rate of the ball on full shots rises, as a result of which the intended distance is not attained. On the other hand, when this value is too large, the initial velocity of the ball on full shots may decrease, as a result of which the intended distance may not be achieved, or the durability to cracking on repeated impact may worsen.

The value obtained by subtracting the material hardness of the envelope layer from the material hardness of the intermediate layer, expressed on the Shore C hardness scale, is preferably larger than 0, more preferably 2 or more, and even more preferably 5 or more. The upper limit value is preferably not more than 20, more preferably not more than 15, and even more preferably not more than 10. When this value is too small, the spin rate of the ball on full shots may rise, as a result of which the intended distance may not be attained. On the other hand, when this value is too large, the initial velocity of the ball on full shots may decrease, as a result of which the intended distance may not be achieved, or the durability to cracking on repeated impact may worsen.

The value obtained by subtracting the surface hardness of the core from the material hardness of the envelope layer, expressed on the Shore C hardness scale, is 0 or more, preferably 1 or more, and more preferably 2 or more. The upper limit value is preferably not more than 17, more preferably not more than 12, and even more preferably not more than 7. When this value is too small, the spin rate of the ball on full shots rises, as a result of which the intended distance is not attained. On the other hand, when this value is too large, the initial velocity of the ball on full shots may decrease, as a result of which the intended distance may not be achieved, or the durability to cracking on repeated impact may worsen.

"Thickness×Material Hardness" Value Relationship Among Layers

In this invention, the "material hardness×thickness" values of the envelope layer and the cover must satisfy the following condition:

thickness (mm) of envelope layer×material hardness (Shore D hardness) of envelope layer≥thickness (mm) of cover×material hardness (Shore D hardness) of cover. The value of {thickness (mm) of envelope layer×material hardness (Shore D hardness) of envelope layer−thickness (mm) of cover×material hardness (Shore D hardness) of cover} is generally 0 or more, preferably 20 or more, and more preferably 50 or more. The upper limit is generally not more than 250, preferably not more than 200, and more preferably not more than 120. When this value falls outside of the above range, it is difficult to achieve both a lower spin rate on full shots and a high initial velocity, as a result of which the intended distance may not be achieved.

Also, in this invention, it is preferable for the ball to satisfy the following condition:

thickness (mm) of envelope layer×material hardness (Shore *D* hardness) of envelope layer≥thickness (mm) of intermediate layer×material hardness (Shore *D* hardness) of intermediate layer.

The value of {thickness (mm) of envelope layer×material hardness (Shore D hardness) of envelope layer−thickness (mm) of intermediate layer×hardness (Shore D hardness) of intermediate layer} is generally 0 or more, preferably 30 or more, and more preferably 60 or more. The upper limit is generally not more than 260, preferably not more than 210, and more preferably not more than 130. When this value falls outside of the above range, it is difficult to achieve both a lower spin rate on full shots and a high initial velocity, as a result of which the intended distance may not be achieved.

Thickness Relationship Among Layers

As noted above, it is preferable for the thickness relationship among the layers to satisfy the following condition:

(cover thickness+intermediate layer thickness)<envelope layer thickness. That is, the "envelope layer thickness/(cover thickness+intermediate layer thickness)" value is preferably larger than 1.0, more preferably 1.1 or more, and even more preferably 1.2 or more. The upper limit value is preferably not more than 2.0, more preferably not more than 1.8, and even more preferably not more than 1.6. Also, the value obtained by subtracting the sum of the cover thickness and the intermediate layer thickness from the envelope layer thickness is larger than 0, preferably 0.2 or more, and more preferably 0.4 or more. The upper limit value is preferably not more than 2.1, more preferably not more than 1.8, and even more preferably not more than 1.5. At values outside of these ranges, it is difficult to achieve both a lower spin rate on full shots and a high initial velocity, and so the intended distance may not be attainable.

The value obtained by subtracting the intermediate layer thickness from the envelope layer thickness is preferably at least 1.00 mm, more preferably at least 1.30 mm, and even more preferably at least 1.60 mm. The upper limit value is preferably not more than 3.20 mm, more preferably not more than 3.00 mm, and even more preferably not more than 2.80 mm. At values outside of this range, it is difficult to achieve both a lower spin rate on full shots and a high initial velocity, and so the intended distance may not be attainable.

Relationship Between Volume and Hardness of Each Layer

In the golf ball of the invention, letting Core·vh be the value expressed as [core volume ($mm^3$)×(Shore C hardness at core surface+Shore C hardness at core center)/2], E·vh be the value expressed as [volume ($mm^3$) of envelope layer material portion×Shore C hardness of envelope layer material] and I·vh be the value expressed as [volume ($mm^3$) of intermediate layer material portion×Shore C hardness of intermediate layer material], the ball preferably satisfies the condition:

$$0.80 \leq (E \cdot vh + I \cdot vh)/\text{Core} \cdot vh \leq 2.00.$$

The value of (E·vh+I·vh)/Core·vh is preferably 0.80 or more, more preferably 1.00 or more, and even more preferably 1.10 or more. The upper limit value is preferably not more than 2.00, more preferably not more than 1.90, and even more preferably not more than 1.80. Outside of this range, it is difficult to obtain both a lower spin rate on full shots and a high initial velocity, and so the intended distance may not be attainable.

The Core·vh value is preferably 700 or more, more preferably 800 or more, and even more preferably 900 or more. The upper limit value is preferably not more than 1,600, more preferably not more than 1,400, and even more preferably not more than 1,200. When this value is too large, the spin rate may rise, resulting in a poor distance, or the feel at impact may become too hard. On the other hand, when this value is too small, the rebound may become too low, resulting in a poor distance, the feel at impact may become too soft, or the durability to cracking on repeated impact may worsen.

The E·vh value is preferably 650 or more, more preferably 750 or more, and even more preferably 850 or more. The upper limit value is preferably not more than 1,600, more preferably not more than 1,400, and even more preferably not more than 1,200. At E·vh values outside of this range, the spin rate on full shots may rise and the intended distance may not be attainable.

The I·vh value is preferably 260 or more, more preferably 360 or more, and even more preferably 460 or more. The upper limit value is preferably not more than 850, more preferably not more than 700, and even more preferably not more than 560. At I·vh values outside of this range, the spin rate on full shots may rise, as a result of which the intended distance may not be attainable.

Numerous dimples may be formed on the outside surface of the cover. The number of dimples arranged on the cover surface, although not particularly limited, is preferably at least 250, more preferably at least 300, and even more preferably at least 320. The upper limit is preferably not more than 440, more preferably not more than 400, and even more preferably not more than 360. When the number of dimples is higher than this range, the ball trajectory may become lower and the distance traveled by the ball may decrease. On the other hand, when the number of dimples is lower that this range, the ball trajectory may become higher and a good distance may not be achieved. The arrangement of these dimples may have symmetry that follows a tetrahedral, octahedral, dodecahedral or other polyhedral/polygonal shape, or may have rotational symmetry about an axis connecting the poles of the ball.

It is recommended that preferably two or more dimple types, and more preferably three or more dimple types, of mutually differing diameter and/or depth be formed. With regard to the planar shapes of the dimples, a single dimple shape or a combination of two or more dimple shapes, such as circular shapes, various polygonal shapes, dewdrop shapes and oval shapes, may be suitably used. For example, when circular dimples are used, the dimple diameter may be set to at least about 2.5 mm and up to about 6.5 mm, and the dimple depth may be set to at least 0.07 mm and up to 0.30 mm. The cross-sectional shapes of the dimples may be defined as one or a combination of two or more types, including arcuate shapes, conical shapes, flat-bottomed shapes and curves expressed by various functions, and may have, other than near the dimple edges, a plurality of inflection points.

In order for the aerodynamic properties to be fully manifested, it is desirable for the dimple coverage ratio, i.e., the dimple surface coverage SR, which is the collective surface area of the imaginary spherical surfaces circumscribed by the edges of the individual dimples, as a percentage of the spherical surface area of the golf ball, to be set to at least 70% and not more than 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of the dimple, with respect to the volume of the ball sphere were the ball to have no dimples on its surface, to be set to at least 0.6% and not more than 1.0%. Outside of the above ranges in these respective values, the resulting trajectory may not enable a good distance to be achieved and so the ball may fail to travel a fully satisfactory distance. Also, to satisfy the rule for symmetry of the ball's carry, dimple volumes near the poles may be made smaller and dimple volumes near the equator may be made larger than the volumes of dimples away from the poles and the equator.

A coating layer may be formed on the cover surface. This coating layer can be applied using any of various types of coatings. Given the need for the coating to endure the harsh conditions of golf ball use, it is preferable to use a coating composition made up primarily of a urethane coating composed of a polyol and a polyisocyanate.

Polyols that may be used in the coating composition include, for example, acrylic polyols and polyester polyols. These polyols encompass also modified forms thereof. Other polyols may also be added in order to increase the ease of the coating operation.

It is preferable to use two types of polyester polyol together as the polyol component. Letting the two types of polyester polyols be component (a) and component (b), a polyester polyol in which a cyclic structure has been introduced onto the resin backbone may be used as the polyester polyol serving as component (a). Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a hyperbranched structure may be used as the polyester polyol serving as component (b). Examples include polyester polyols having a branched structure, such as NIPPOLAN 800 from Tosoh Corporation.

As for the polyisocyanate, although not particularly limited, an aromatic, aliphatic, alicyclic or other polyisocyanate is commonly used. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate and 1-isocyanto-3,3,5-trimethyl-4-isocyanatomethylcyclohexane. These may be used singly or in admixture.

Depending on the coating conditions, various organic solvents may be mixed into the coating composition. Such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methylcyclohexane and ethylcyclohexane; and petroleum hydrocarbon solvents such as mineral spirits.

The thickness of the coating layer composed of the above coating composition, although not particularly limited, is generally from 5 to 40 μm, and preferably from 10 to 20 μm. As used herein, "coating layer thickness" refers to the thickness of the applied coat as determined by measuring the thickness at a total of three places—the center of a dimple and two places located between the center of the dimple and the dimple edge—and averaging the measured values.

In this invention, the coating layer made of the above coating composition has an elastic work recovery that is preferably at least 60%, and more preferably at least 80%. At a coating layer elastic work recovery in this range, the coating layer has a high elasticity and so the self-repairing ability is high, resulting in an outstanding abrasion resistance. Moreover, the performance attributes of golf balls coated with this coating composition can be improved. The method of measuring the elastic work recovery is described below.

The elastic work recovery is one parameter of the nanoindentation method for evaluating the physical properties of coating layers, this being a nanohardness test method that controls the indentation load on a micro-newton (μN) order and tracks the indenter depth during indentation to a nanometer (nm) precision. In prior methods, only the size of the deformation (plastic deformation) mark corresponding to the maximum load could be measured. However, in the nanoindentation method, the relationship between the indentation load and the indentation depth can be obtained by continuous automated measurement. Hence, unlike in the past, there are no individual differences between observers when visually measuring a deformation mark under an optical microscope, and so it is thought that the physical properties of the coating layer can be precisely evaluated.

Given that the coating layer on the ball surface is strongly affected by the impact of the driver and various other types of clubs and has a not inconsiderable influence on the golf ball properties, measuring the coating layer by the nano-hardness test method and carrying out such measurement to a higher precision than in the past is a very effective method of evaluation.

The hardness of the coating layer, as expressed on the Shore M hardness scale, is preferably at least 40, and more preferably at least 60. The upper limit is preferably not more than 95, and more preferably not more than 85. This Shore M hardness is obtained in accordance with ASTM D2240. The hardness of the coating layer, as expressed on the Shore C hardness scale, is preferably at least 40, and more preferably at least 50. The upper limit is preferably not more than 80, and more preferably not more than 70. This Shore C hardness is obtained in accordance with ASTM D2240. At coating layer hardnesses that are higher than these ranges, the coat may become brittle when the ball is repeatedly struck, which may make it incapable of protecting the cover layer. On the other hand, coating layer hardnesses that are lower than the above range are undesirable because the ball surface may be more easily damaged when striking a hard object and mud may stick more readily to the ball.

When the above coating composition is used, the formation of a coating layer on the surface of golf balls manufactured by a known method can be carried out via the steps of preparing the coating composition at the time of application, applying the composition onto the golf ball surface by a conventional coating operation, and drying the applied composition. The coating method is not particularly limited. For example, spray painting, electrostatic painting or dipping may be suitably used.

The multi-piece solid golf ball of the invention can be made to conform to the Rules of Golf for play. The inventive ball may be formed to a diameter which is such that the ball does not pass through a ring having an inner diameter of 42.672 mm, and to a weight which is preferably between 45.0 and 45.93 g.

EXAMPLES

The following Examples and Comparative Examples are provided to illustrate the invention, and are not intended to limit the scope thereof.

Examples 1 to 5, Comparative Examples 1 to 8

Formation of Core

Solid cores were produced by preparing rubber compositions for Examples 1 to 4 and Comparative Examples 1 to 7 shown in Table 1, and then vulcanizing the compositions under the vulcanization conditions for each example that are shown in Table 1.

In Example 5 and Comparative Example 8, a core is produced in the same way as described above using the formulation shown in Table 1.

TABLE 1

| Core formulation | | Example | | | | | Comparative Example | | | | | | | |
|---|---|---|---|---|---|---|---|---|---|---|---|---|---|---|
| (pbw) | | 1 | 2 | 3 | 4 | 5 | 1 | 2 | 3 | 4 | 5 | 6 | 7 | 8 |
| Polybutadiene A | | 50 | 50 | 50 | 50 | 50 | 50 | 50 | 50 | 50 | 50 | 50 | 50 | 50 |
| Polybutadiene B | | 50 | 50 | 50 | 50 | 50 | 50 | 50 | 50 | 50 | 50 | 50 | 50 | 50 |
| Zinc acrylate | | 21.0 | 18.8 | 22.1 | 19.9 | 19.4 | 25.3 | 23.2 | 26.4 | 24.2 | 22.1 | 26.4 | 24.2 | 21.0 |
| Organic peroxide (1) | | 0.6 | 0.6 | 0.6 | 0.6 | 0.6 | 0.6 | 0.6 | 0.6 | 0.6 | 0.6 | 0.6 | 0.6 | 0.6 |
| Organic peroxide (2) | | 0.6 | 0.6 | 0.6 | 0.6 | 0.6 | 0.6 | 0.6 | 0.6 | 0.6 | 0.6 | 0.6 | 0.6 | 0.6 |
| Antioxidant | | 0.1 | 0.1 | 0.1 | 0.1 | 0.1 | 0.1 | 0.1 | 0.1 | 0.1 | 0.1 | 0.1 | 0.1 | 0.1 |
| Zinc oxide | | 67.3 | 67.8 | 52.7 | 53.4 | 60.6 | 37.5 | 38.3 | 28.0 | 28.9 | 29.7 | 28.0 | 28.9 | 67.3 |
| Vulcanization | Temp. (° C.) | 155 | 155 | 155 | 155 | 155 | 155 | 155 | 155 | 155 | 155 | 155 | 155 | 155 |
| | Time (minutes) | 14 | 14 | 14 | 14 | 14 | 14 | 14 | 14 | 14 | 14 | 14 | 14 | 14 |

Details on the ingredients mentioned in Table 1 are given below.

Polybutadiene A: Available under the trade name "BR 01" from JSR Corporation

Polybutadiene B: Available under the trade name "BR51" from JSR Corporation

Zinc acrylate: Available as "ZN-DA85S" from Nippon Shokubai Co., Ltd.

Organic Peroxide (1): Dicumyl peroxide, available under the trade name "Percumyl D" from NOF Corporation Organic Peroxide (2): Mixture of 1,1-di(t-butylperoxy)cyclohexane and silica, available under the trade name "Perhexa C-40" from NOF Corporation Antioxidant: 2,2'-Methylenebis(4-methyl-6-butylphenol), available under the trade name "Nocrac NS-6" from Ouchi Shinko Chemical Industry Co., Ltd.

Zinc oxide: Available as "Grade 3 Zinc Oxide" from Sakai Chemical Co., Ltd.

Formation of Envelope Layer

Next, in Examples 1 to 4 and Comparative Examples 1 and 2, an envelope layer was formed by injection-molding the envelope layer material of formulation No. 1 shown in Table 2 over the core. In Example 5 and Comparative Example 8, an envelope layer is formed in the same way as described above using formulation No. 1 in Table 2. No envelope layer was formed in Comparative Examples 3 to 7.

Formation of Intermediate Layer

Next, in Examples 1 to 4 and Comparative Examples 1 and 2, an intermediate layer was formed by injection-molding the intermediate layer material of formulation No. 2 shown in Table 2 over the envelope layer-encased sphere obtained as described above. In Comparative Examples 3 to 7, an intermediate layer was formed by injection-molding the intermediate layer material of formulation No. 1 or No. 2 shown in Table 2 over the core obtained as described above. In Example 5 and Comparative Example 8, an intermediate layer is formed in the same way as in Examples 1 to 4 and Comparative Examples 1 and 2 using formulation No. 2 in Table 2.

Formation of Cover (Outermost Layer)

Next, a cover (outermost layer) was formed by injection-molding the cover material of formulation No. 3 shown in Table 2 over the intermediate layer-encased sphere obtained in the respective examples. Numerous dimples in a given configuration common to all of the Examples and Comparative Examples were formed at this time on the cover surface. In Example 5 and Comparative Example 8, a cover having numerous dimples on the outside surface is formed in the same way as described above.

TABLE 2

| Resin composition (pbw) | No. 1 | No. 2 | No. 3 | No. 4 |
|---|---|---|---|---|
| HPF 2000 | 100 | | | |
| HPF 1000 | | 100 | | |
| Himilan 1605 | | | 50 | |
| Himilan 1706 | | | 25 | |
| AM 7329 | | | 25 | |
| Surlyn 7930 | | | | 47 |
| Surlyn 6320 | | | | 40 |
| Nucrel 9-1 | | | | 13 |
| Low-molecular-weight polyolefin | | | 1.0 | |
| Magnesium stearate | | | 1.7 | |
| Titanium oxide | | | 2.8 | 5.0 |

Trade names of the chief materials mentioned in the table are given below.
HPF 1000, HPF 2000: Available under the trademark "HPF" from The Dow Chemical Company
Himilan 1605, Himilan 1706, AM7329: Ionomers available from Dow-Mitsui Polychemicals Co., Ltd.
Surlyn 7930, Surlyn 6320: An ionomer available from The Dow Chemical Company
Nucrel 9-1: Available under the trademark "Nucrel" from E.I. DuPont de Nemours and Co.
Low-molecular-weight polyolefin: Available as "Sanwax 161-P" from Sanyo Chemical Industries, Ltd.
Magnesium stearate: Available as "Zinc Stearate G" from NOF Corporation
Titanium oxide: Available as "A-190" from Sakai Chemical Industry Co., Ltd.

Figure 2A:
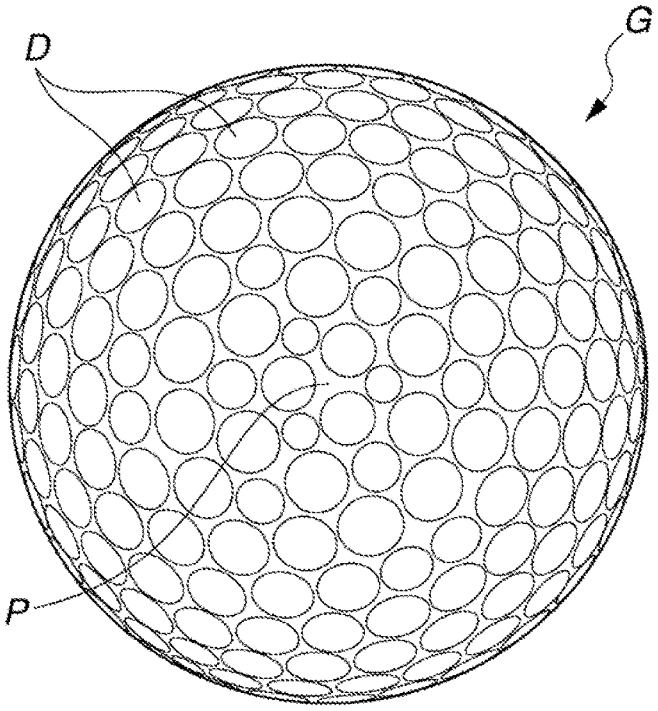
FIGS. 2A and 2B show plan views depicting the arrangement (pattern) of dimples common to the Examples and the Comparative Examples described in the Specification, FIG. 2A being a plan view of the dimples as seen from directly above and centered on a pole of the ball, and FIG. 2B being a plan view of the dimples as seen obliquely from above with the pole of the ball in FIG. 2A shifted upward.
Figure 2B:
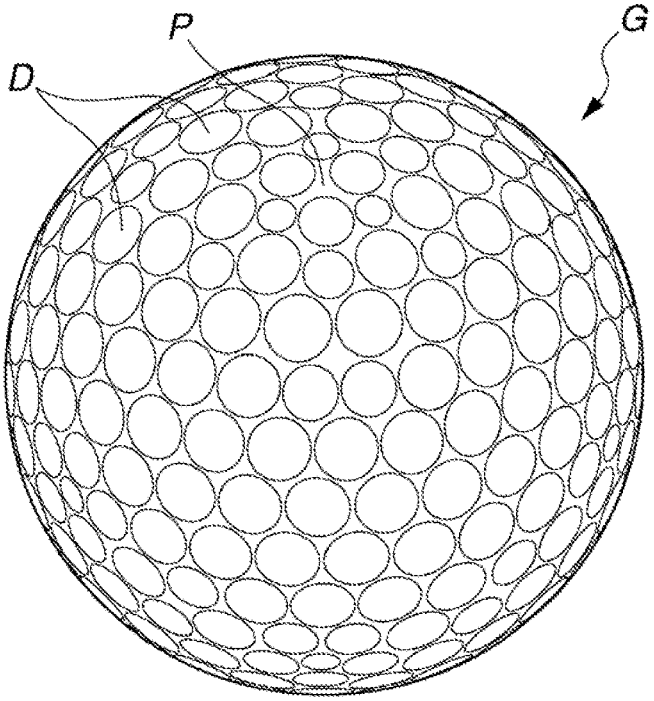

Eight types of circular dimples are used as dimples common to all of the Examples and Comparative Examples. Details on the dimples are shown in Table 3, and the arrangement of dimples on the ball's surface is shown in FIGS. 2A and 2B. FIG. 2A is a plan view of the dimples as seen from directly above and centered on a pole of the ball; FIG. 2B is a plan view of the dimples as seen obliquely from above with the pole of the ball in FIG. 2A shifted upward. The symbols D in FIGS. 2A and 2B indicate dimples and the symbol P indicates a pole of the golf ball.

TABLE 3

| Dimples D | Number | Diameter (mm) | Depth (mm) | Volume ($mm^3$) | Cylinder volume ratio $V_0$ | SR (%) | VR (%) |
|---|---|---|---|---|---|---|---|
| D-1 | 12 | 4.62 | 0.126 | 1.021 | 0.484 | 81.6 | 0.73 |
| D-2 | 198 | 4.42 | 0.127 | 0.937 | 0.479 | | |
| D-3 | 36 | 3.85 | 0.122 | 0.675 | 0.476 | | |
| D-4 | 12 | 2.73 | 0.111 | 0.251 | 0.388 | | |
| D-5 | 36 | 4.40 | 0.167 | 1.225 | 0.483 | | |
| D-6 | 24 | 3.87 | 0.160 | 0.891 | 0.474 | | |
| D-7 | 6 | 3.45 | 0.183 | 0.819 | 0.480 | | |
| D-8 | 6 | 3.48 | 0.136 | 0.528 | 0.409 | | |
| Total | 330 | | | | | | |

Dimple Definitions

Edge: Highest place in cross-section passing through center of dimple.

Diameter: Diameter of flat plane circumscribed by edge of dimple.

Depth: Maximum depth of dimple from flat plane circumscribed by edge of dimple.

SR: Sum of individual dimple surface areas, each defined by flat plane circumscribed by edge of dimple, as a percentage of spherical surface area of ball were it to have no dimples thereon.

Dimple volume: Dimple volume below flat plane circumscribed by edge of dimple.

Cylinder volume ratio $V_0$: Ratio of dimple volume to volume of cylinder having same diameter and depth as dimple.

VR: Sum of volumes of individual dimples formed below flat plane circumscribed by edge of dimple, as a percentage of volume of ball sphere were it to have no dimples thereon.

Each of the golf balls obtained is evaluated by the following methods for various properties, including the core surface and center hardnesses, the diameters of the core and each layer-encased sphere, and the thickness and material hardnesses of each layer. The results are shown in Table 4. In Table 4, "envelope layer (thickness×hardness)–cover (thickness×hardness)" refers to {thickness (mm) of envelope layer×material hardness (Shore D hardness) of envelope layer–thickness (mm) of cover×material hardness (Shore D hardness) of cover}, and "envelope layer (thickness×hardness)–intermediate layer (thickness×hardness)" refers to {thickness (mm) of envelope layer×material hardness (Shore D hardness) of envelope layer–thickness (mm) of intermediate layer×hardness (Shore D hardness) of intermediate layer}.

Diameters of Core, Envelope Layer-Encased Sphere and Intermediate Layer-Encased Sphere The spheres to be measured are held isothermally at 23.9±1° C. for at least 3 hours in a thermostatic chamber, following which they are measured in a 23.9±2° C. room. The diameters at five random places on the surface of each sphere are measured; using the average of these measurements as the measured value for a single sphere, the average diameter for ten spheres is determined.

Ball Diameter

The balls to be measured are held isothermally at 23.9±1° C. for at least 3 hours in a thermostatic chamber, following which they are measured in a 23.9±2° C. room. The diameters at 15 random dimple-free areas are measured; using the average of these measurements as the measured value for a single ball, the average diameter for ten balls is determined.

Core and Ball Deflections

The core or ball is placed on a hard plate and the amount of deflection when compressed under a final load of 1,275 N (130 kgf) from an initial load of 98 N (10 kgf) is measured. The core or ball to be measured is held isothermally at 23.9±1° C. for at least 3 hours in a thermostatic chamber, following which it is measured in a 23.9±2° C. room. The rate at which pressure is applied by the head which compresses the core or ball is set to 10 mm/s.

Center and Surface Hardnesses of Core

The core has a spherical surface. The indenter of a durometer is set substantially perpendicular to this spherical surface, and the surface hardness Cs of the core is measured on the Shore C hardness scale in accordance with ASTM D2240. The P2 Automatic Rubber Hardness Tester (Kobunshi Keiki Co., Ltd.) equipped with a Shore C durometer can be used for measuring the hardness. The maximum value is read off as the hardness value. All measurements are carried out in a 23±2° C. environment. The core center hardness Cc is measured by perpendicularly pressing the indenter of the durometer against the place to be measured on a flat cross-section obtained by cutting the core into hemispheres. The results are indicated in Shore C hardness values.

Material Hardnesses of Envelope Layer, Intermediate Layer and Cover (Shore C and Shore D Hardnesses)

The resin material for each layer is molded into sheets having a thickness of 2 mm and left to stand for at least two weeks at a temperature of 23±2° C. Three sheets are stacked together and used at the time of measurement. The Shore C hardness and Shore D hardness of each material are measured with, respectively, a Shore C durometer and a Shore D durometer in accordance with ASTM D2240. The P2 Automatic Rubber Hardness Tester (Kobunshi Keiki Co., Ltd.) equipped with a Shore C durometer or a Shore D durometer can be used to measure the hardness. The maximum value is read off as the hardness value.

TABLE 4

| | | Example | | | | | Comparative Example | |
|---|---|---|---|---|---|---|---|---|
| | | 1 | 2 | 3 | 4 | 5 | 1 | 2 |
| | Construction (piece) | 4P | 4P | 4P | 4P | 4P | 4P | 4P |
| Core | Diameter (mm) | 29.70 | 29.67 | 31.89 | 31.90 | 30.79 | 34.91 | 34.87 |
| | Weight (g) | 19.56 | 19.59 | 22.85 | 22.91 | 21.25 | 28.20 | 28.08 |
| | Deflection (mm) | 3.92 | 4.37 | 3.84 | 4.30 | 4.33 | 3.12 | 3.60 |
| | Core surface hardness: Cs (Shore C) | 77.4 | 73.7 | 77.7 | 73.4 | 73.6 | 79.2 | 76.0 |
| | Core center hardness: Cc (Shore C) | 63.3 | 60.9 | 61.7 | 60.2 | 60.6 | 67.0 | 63.3 |
| | Hardness difference (Core surface − Core center) (Shore C) | 14.1 | 12.8 | 16.0 | 13.2 | 13.0 | 12.2 | 12.7 |
| | Core · vh | 965 | 920 | 1,184 | 1,135 | 1,028 | 1,628 | 1,546 |
| Envelope layer | Material (type) | No. 1 | No. 1 | No. 1 | No. 1 | No. 1 | No. 1 | No. 1 |
| | Thickness (mm) | 4.01 | 4.02 | 2.90 | 2.90 | 3.46 | 1.43 | 1.45 |
| | Material hardness (Shore C) | 78 | 78 | 78 | 78 | 78 | 78 | 78 |
| | Material hardness (Shore D) | 48 | 48 | 48 | 48 | 48 | 48 | 48 |
| Envelope layer-encased sphere | Diameter (mm) | 37.71 | 37.71 | 37.69 | 37.70 | 37.71 | 37.77 | 37.77 |
| | Weight (g) | 33.24 | 33.36 | 33.45 | 33.47 | 33.41 | 33.85 | 33.85 |
| | E · vh | 1,120 | 1,123 | 862 | 863 | 993 | 463 | 469 |
| Envelope layer material hardness − Core surface hardness (Shore C) | | 1 | 4 | 0 | 5 | 4 | −1 | 2 |
| Intermediate layer | Material (type) | No. 2 | No. 2 | No. 2 | No. 2 | No. 2 | No. 2 | No. 2 |
| | Thickness (mm) | 1.25 | 1.25 | 1.26 | 1.25 | 1.25 | 1.23 | 1.23 |
| | Material hardness (Shore C) | 85 | 85 | 85 | 85 | 85 | 85 | 85 |
| | Material hardness (Shore D) | 53 | 53 | 53 | 53 | 53 | 53 | 53 |
| Intermediate layer-encased sphere | Diameter (mm) | 40.21 | 40.21 | 40.21 | 40.20 | 40.21 | 40.23 | 40.22 |
| | Weight (g) | 39.02 | 39.11 | 39.25 | 39.23 | 39.17 | 39.56 | 39.51 |
| | I · vh | 507 | 507 | 511 | 507 | 507 | 500 | 498 |
| Intermediate layer material hardness − Envelope layer material hardness (Shore C) | | 7 | 7 | 7 | 7 | 7 | 7 | 7 |
| Envelope layer thickness − Intermediate layer thickness (mm) | | 2.76 | 2.77 | 1.64 | 1.65 | 2.21 | 0.20 | 0.23 |
| Cover | Material (type) | No. 3 | No. 3 | No. 3 | No. 3 | No. 3 | No. 3 | No. 3 |
| | Thickness (mm) | 1.26 | 1.26 | 1.26 | 1.26 | 1.26 | 1.26 | 1.26 |
| | Material hardness (Shore C) | 95 | 95 | 95 | 95 | 95 | 95 | 95 |
| | Material hardness (Shore D) | 63 | 63 | 63 | 63 | 63 | 63 | 63 |
| Dimples | Type | D | D | D | D | D | D | D |
| Ball | Diameter (mm) | 42.73 | 42.73 | 42.72 | 42.72 | 42.73 | 42.74 | 42.73 |
| | Weight (g) | 45.22 | 45.29 | 45.43 | 45.42 | 45.35 | 45.69 | 45.65 |
| | Deflection (mm) | 2.77 | 2.93 | 2.82 | 3.04 | 2.98 | 2.66 | 2.90 |
| Envelope layer (thickness × hardness) − Cover (thickness × hardness) | | 113 | 114 | 60 | 60 | 87 | −10 | −9 |
| Envelope layer (thickness × hardness) − Intermediate layer (thickness × hardness) | | 126 | 127 | 72 | 73 | 100 | 3 | 5 |
| Cover thickness + Intermediate layer thickness (mm) | | 2.51 | 2.51 | 2.52 | 2.51 | 2.51 | 2.49 | 2.48 |

TABLE 4-continued

| | | | | | | | |
|---|---|---|---|---|---|---|---|
| Envelope layer thickness/(Cover thickness + Intermediate layer thickness) | 1.6 | 1.6 | 1.2 | 1.2 | 1.4 | 0.6 | 0.6 |
| Envelope layer thickness − (Cover thickness + Intermediate layer thickness) (mm) | 1.5 | 1.5 | 0.4 | 0.4 | 1.0 | −1.1 | −1.0 |
| Cover material hardness − Intermediate layer material hardness (Shore C) | 10 | 10 | 10 | 10 | 10 | 10 | 10 |
| Core diameter/Ball diameter | 0.695 | 0.694 | 0.746 | 0.747 | 0.721 | 0.817 | 0.816 |
| (E · vh + I · vh)/Core · vh | 1.69 | 1.77 | 1.16 | 1.21 | 1.46 | 0.59 | 0.63 |
| Core deflection − Ball deflection (mm) | 1.15 | 1.44 | 1.02 | 1.25 | 1.35 | 0.46 | 0.71 |

| | | Comparative Example | | | | | |
|---|---|---|---|---|---|---|---|
| | | 3 | 4 | 5 | 6 | 7 | 8 |
| | Construction (piece) | 3P | 3P | 3P | 3P | 3P | 4P |
| Core | Diameter (mm) | 37.27 | 37.25 | 37.25 | 37.27 | 37.25 | 29.70 |
| | Weight (g) | 32.77 | 32.77 | 32.76 | 32.77 | 32.77 | 19.56 |
| | Deflection (mm) | 3.14 | 3.51 | 3.88 | 3.14 | 3.51 | 3.92 |
| | Core surface hardness: Cs (Shore C) | 81.2 | 78.7 | 75.0 | 81.2 | 78.7 | 77.4 |
| | Core center hardness: Cc (Shore C) | 69.7 | 66.1 | 63.8 | 69.7 | 66.1 | 63.3 |
| | Hardness difference (Core surface − Core center) (Shore C) | 11.5 | 12.6 | 11.2 | 11.5 | 12.6 | 14.1 |
| | Core · vh | 2,045 | 1,959 | 1,878 | 2,045 | 1,959 | 965 |
| Envelope layer | Material (type) | | | | | | No. 1 |
| | Thickness (mm) | | | | | | 4.01 |
| | Material hardness (Shore C) | | | | | | 78 |
| | Material hardness (Shore D) | | | | | | 48 |
| Envelope layer-encased sphere | Diameter (mm) | | | | | | 37.71 |
| | Weight (g) | | | | | | 33.24 |
| | E · vh | | | | | | 1,120 |
| Envelope layer material hardness − Core surface hardness (Shore C) | | | | | | | 1 |
| Intermediate layer | Material (type) | No. 2 | No. 2 | No. 2 | No. 1 | No. 1 | No. 2 |
| | Thickness (mm) | 1.38 | 1.40 | 1.40 | 1.38 | 1.39 | 1.25 |
| | Material hardness (Shore C) | 85 | 85 | 85 | 78 | 78 | 85 |
| | Material hardness (Shore D) | 53 | 53 | 53 | 48 | 48 | 53 |
| Intermediate layer-encased sphere | Diameter (mm) | 40.02 | 40.04 | 40.05 | 40.03 | 40.03 | 40.21 |
| | Weight (g) | 38.87 | 38.90 | 38.94 | 38.96 | 38.97 | 39.02 |
| | I · vh | 549 | 557 | 559 | 505 | 509 | 507 |
| Intermediate layer material hardness − Envelope layer material hardness (Shore C) | | | | | | | 7 |
| Envelope layer thickness − Intermediate layer thickness (mm) | | | | | | | 2.76 |
| Cover | Material (type) | No. 3 | No. 3 | No. 3 | No. 3 | No. 3 | No. 4 |
| | Thickness (mm) | 1.33 | 1.33 | 1.32 | 1.34 | 1.34 | 1.26 |
| | Material hardness (Shore C) | 95 | 95 | 95 | 95 | 95 | 80 |
| | Material hardness (Shore D) | 63 | 63 | 63 | 63 | 63 | 50 |
| Dimples | Type | D | D | D | D | D | D |
| Ball | Diameter (mm) | 42.68 | 42.70 | 42.69 | 42.70 | 42.71 | 42.73 |
| | Weight (g) | 45.52 | 45.52 | 45.53 | 45.58 | 45.58 | 45.22 |
| | Deflection (mm) | 2.65 | 2.91 | 3.18 | 2.71 | 2.99 | 2.84 |
| Envelope layer (thickness × hardness) − Cover (thickness × hardness) | | — | — | — | — | — | 129 |
| Envelope layer (thickness × hardness) − Intermediate layer (thickness × hardness) | | — | — | — | — | — | 126 |
| Cover thickness + Intermediate layer thickness (mm) | | 2.71 | 2.73 | 2.72 | 2.72 | 2.73 | 2.51 |
| Envelope layer thickness/(Cover thickness + Intermediate layer thickness) | | — | — | — | — | — | 1.6 |
| Envelope layer thickness − (Cover thickness + Intermediate layer thickness) (mm) | | −2.7 | −2.7 | −2.7 | −2.7 | −2.7 | 1.5 |
| Cover material hardness − Intermediate layer material hardness (Shore C) | | 10 | 10 | 10 | 17 | 17 | −5 |
| Core diameter/Ball diameter | | 0.873 | 0.872 | 0.873 | 0.873 | 0.872 | 0.695 |
| (E · vh + I · vh)/Core · vh | | 0.27 | 0.28 | 0.30 | 0.25 | 0.26 | 1.69 |
| Core deflection − Ball deflection (mm) | | 0.49 | 0.60 | 0.70 | 0.43 | 0.52 | 1.08 |

Core · vh: core volume × (core surface hardness + core center hardness)/2

E · vh: volume of envelope layer material portion × Shore C hardness of envelope layer material I · vh: volume of intermediate layer material portion × Shore C hardness of intermediate layer material Evaluations of flight performances (1) to (3) for each golf ball are carried out as described below. The results are shown in Table 5.

(1) Flight Performance (W #1)

A driver (W #1) is mounted on a golf swing robot and the distance traveled by the ball when struck at a head speed of 45 m/s is measured and rated according to the criteria shown below. The club used is the TourStage X-Drive 410 (2007 model; loft angle, 9.5°) manufactured by Bridgestone Sports Co., Ltd. The spin rate of the ball immediately after being similarly struck is measured with a launch monitor.

Rating Criteria

Exc: Total distance is 235.0 m or more

Good: Total distance is at least 234.0 m but less than 235.0 m

NG: Total distance is less than 234.0 mm (2) Flight Performance (W #1)

A driver (W #1) is mounted on a golf swing robot and the distance traveled by the ball when struck at a head speed of 40 m/s is measured and rated according to the criteria shown below. The club used is the TourStage X-Drive 410 (2007 model; loft angle, 9.5°) manufactured by Bridgestone Sports Co., Ltd. The spin rate of the ball immediately after being similarly struck is measured with a launch monitor.

Rating Criteria

Exc: Total distance is 208.0 m or more

Good: Total distance is at least 207.0 m but less than 208.0 m

NG: Total distance is less than 207.0 mm (3) Flight Performance (I #6)

An iron (I #6) is mounted on a golf swing robot and the distance traveled by the ball when struck at a head speed of 40 m/s is measured and rated according to the criteria shown below. The club used is J's Classical Edition (I #6) manufactured by Bridgestone Sports Co., Ltd. The spin rate of the ball immediately after being similarly struck is measured with a launch monitor.

Rating Criteria

Exc: Total distance is 160.0 m or more

Good: Total distance is at least 158.5 m but less than 160.0 m

NG: Total distance is less than 158.5 mm

In Comparative Example 1, the "envelope layer (thickness×material hardness)−cover (thickness×material hardness)" value was negative, the "core deflection−ball deflection" value was smaller than 1.00, and the envelope layer material hardness was lower than the core surface hardness. As a result, in flight performances (2) and (3), the balance between the spin rate on full shots and the initial velocity was poor and so the desired distance was not obtained.

In Comparative Example 2, the "envelope layer (thickness×material hardness)−cover (thickness×material hardness)" value was negative, and the "core deflection−ball deflection" value was smaller than 1.00. As a result, in flight performances (1) and (3), the balance between the spin rate on full shots and the initial velocity was poor and so the desired distance was not obtained.

In Comparative Example 3, the ball had a three-piece construction without an envelope layer. As a result, in flight performance (2), the balance between the spin rate on full shots and the initial velocity was poor and so the desired distance was not obtained.

In Comparative Example 4, the ball had a three-piece construction without an envelope layer. As a result, in flight performances (1) and (2), the balance between the spin rate on full shots and the initial velocity was poor and so the desired distance was not obtained.

In Comparative Example 5, the ball had a three-piece construction without an envelope layer. As a result, in flight performance (2), the balance between the spin rate on full shots and the initial velocity was poor and so the desired distance was not obtained.

In Comparative Example 6, the ball had a three-piece construction without an envelope layer. As a result, in flight performances (1) and (2), the balance between the spin rate on full shots and the initial velocity was poor and so the desired distance was not obtained.

In Comparative Example 7, the ball had a three-piece construction without an envelope layer. As a result, in flight performances (2) and (3), the balance between the spin rate on full shots and the initial velocity was poor and so the desired distance was not obtained.

In Comparative Example 8, the material hardness of the cover is lower than the material hardness of the intermediate layer. The spin rate on full shots with a driver (W #1) rises and so the desired distance is not obtained.

TABLE 5

| | | Example | | | | | Comparative Example | | | | | | | |
|---|---|---|---|---|---|---|---|---|---|---|---|---|---|---|
| | | 1 | 2 | 3 | 4 | 5 | 1 | 2 | 3 | 4 | 5 | 6 | 7 | 8 |
| Flight (1) (W#1) HS = 45 m/s | Spin rate (rpm) | 2,813 | 2,707 | 2,741 | 2,605 | 2,656 | 2,809 | 2,714 | 2,800 | 2,750 | 2,639 | 2,787 | 2,700 | 2,992 |
| | Total distance (m) | 235.8 | 234.6 | 236.0 | 236.0 | 235.3 | 235.2 | 233.9 | 235.5 | 233.9 | 234.4 | 233.9 | 235.9 | 232.1 |
| | Rating | Exc | Good | Exc | Exc | Exc | Exc | NG | Exc | NG | Good | NG | Exc | NG |
| Flight (2) (W#1) HS = 40 m/s | Spin rate (rpm) | 2,854 | 2,790 | 2,776 | 2,761 | 2,776 | 2,832 | 2,760 | 2,867 | 2,814 | 2,700 | 2,783 | 2,748 | 3,072 |
| | Total distance (m) | 208.1 | 208.2 | 207.4 | 208.5 | 208.3 | 205.4 | 208.5 | 204.6 | 206.9 | 203.6 | 205.3 | 205.4 | 204.9 |
| | Rating | Exc | Exc | Good | Exc | Exc | NG | Exc | NG | NG | NG | NG | NG | NG |
| Flight (3) (I#6) HS = 40 m/s | Spin rate (rpm) | 6,007 | 5,747 | 5,689 | 5,453 | 5,600 | 5,900 | 5,739 | 6,009 | 5,747 | 5,544 | 6,051 | 5,841 | 5,887 |
| | Total distance (m) | 158.7 | 158.9 | 160.2 | 163.2 | 161.1 | 156.6 | 158.1 | 159.4 | 159.4 | 163.4 | 158.6 | 158.4 | 159.0 |
| | Rating | Good | Good | Exc | Exc | Exc | NG | NG | Good | Good | Exc | Good | NG | Good |

As demonstrated by the results in Table 5, the golf balls of Comparative Examples 1 to 8 are inferior in the following respects to the golf balls according to the present invention that are obtained in Examples 1 to 5.

Japanese Patent Application No. 2022-062202 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an envelope layer, an intermediate layer and a cover, wherein the core is formed of one or more layer of a rubber composition; the envelope layer, intermediate layer and cover are each formed of a single layer of resin material; the hardness relationship among the layers, in terms of Shore C hardness values, satisfies the following two conditions:

material hardness of cover>material hardness of intermediate layer, and material hardness of envelope layer≥surface hardness of core;

the ball additionally satisfies the condition:

thickness (mm) of envelope layer×material hardness (Shore D hardness) of envelope layer≥thickness (mm) of cover×material hardness (Shore D hardness) of cover; and, letting C be the deflection of the core in millimeters when compressed under a final load of 1,275 N (130 kgf) from an initial load of 98 N (10 kgf) and B be the deflection of the ball in millimeters when compressed under a final load of 1,275 N (130 kgf) from an initial load of 98 N (10 kgf), C-B has a value of 1.00 mm or more, and the ball satisfies the condition:

$$0.80 \leq (E \cdot vh + I \cdot vh)/\text{Core} \cdot vh \leq 2.00,$$

wherein Core vh is the value expressed as [core volume ($mm^3$)×(Shore C hardness at core surface+Shore C hardness at core center)/2], E·vh is the value expressed as [volume ($mm^3$) of envelope layer material portion×Shore C hardness of envelope layer material] and I·vh is the value expressed as [volume ($mm^3$) of intermediate layer material portion×Shore C hardness of intermediate layer material].

2. The golf ball of claim 1, wherein the ball additionally satisfies the following condition:

thickness (mm) of envelope layer×material hardness (Shore *D* hardness) of envelope layer≥thickness (mm) of intermediate layer×material hardness (Shore *D* hardness) of intermediate layer.

3. The golf ball of claim 1, wherein the ball satisfies the condition:

(cover thickness+intermediate layer thickness)<envelope layer thickness.

4. The golf ball of claim 1, wherein the hardness relationship among the layers, in terms of Shore C hardness values, satisfies the following condition:

material hardness of cover>material hardness of intermediate layer>material hardness of envelope layer≥surface hardness of core.

5. The golf ball of claim 1, wherein the resin material making up either or both of the envelope layer and the intermediate layer is a highly neutralized resin material comprising:

100 parts by weight of a resin component consisting of, in admixture, (A) a base resin of (a-1) an olefin-unsaturated carboxylic acid random copolymer or a metal ion neutralization product of an olefin-unsaturated carboxylic acid random copolymer or both blended with (a-2) an olefin-unsaturated carboxylic acid-unsaturated carboxylic acid ester random terpolymer or a metal ion neutralization product of an olefin-unsaturated carboxylic acid-unsaturated carboxylic acid ester random terpolymer or both in a weight ratio (a-1):(a-2) of between 100:0 and 0:100, and (B) a non-ionomeric thermoplastic elastomer in a weight ratio (A):(B) of between 100:0 and 50:50;

and also comprising, blended therewith as essential ingredients:

(C) from 5 to 120 parts by weight of a fatty acid or a fatty acid derivative or both having a molecular weight of from 228 to 1,500, and (D) from 0.1 to 17 parts by weight of a basic inorganic metal compound capable of neutralizing un-neutralized acid groups in components (A) and (C).

6. The golf ball of claim 5, wherein the resin materials of both the envelope layer and the intermediate layer are highly neutralized resin materials of mutually differing types which include components (A) to (D) as essential ingredients.

7. The golf ball of claim 1, wherein the layers of the ball have a thickness relationship that satisfies the following condition:

envelope layer thickness/(cover thickness+intermediate layer thickness)≥1.2.

8. The golf ball of claim 1, wherein the core and the ball have diameters that satisfy the following relationship:

$$0.65 \leq (\text{core diameter})/(\text{ball diameter}) \leq 0.78.$$

* * * * *